US008505136B2

(12) United States Patent
Yu et al.

(10) Patent No.: US 8,505,136 B2
(45) Date of Patent: Aug. 13, 2013

(54) PLAYPEN HUB ASSEMBLY AND PLAYPEN USING THE SAME

(75) Inventors: Fu-Sian Yu, Taipei (TW); Xiao-Long Mo, Taipei (TW); Chih-Wei Wang, Taipei (TW)

(73) Assignee: Excellerate Enterprise Co., Ltd., Songshan District, Taipei (TW)

( * ) Notice: Subject to any disclaimer, the term of this patent is extended or adjusted under 35 U.S.C. 154(b) by 270 days.

(21) Appl. No.: 12/541,985

(22) Filed: Aug. 17, 2009

(65) Prior Publication Data

US 2010/0260536 A1 Oct. 14, 2010

(30) Foreign Application Priority Data

Apr. 8, 2009 (CN) ..... 2009 1 0133873

(51) Int. Cl.
*A47D 7/00* (2006.01)

(52) U.S. Cl.
USPC ..... 5/99.1; 403/100; 403/102; 5/98.1

(58) Field of Classification Search
USPC ..... 403/100–102, 217–219, 169, 170, 403/175, 178; 5/98.1, 99.1; 248/169; 135/135, 135/145, 147
See application file for complete search history.

(56) References Cited

U.S. PATENT DOCUMENTS

| | | | | |
|---|---|---|---|---|
| 5,857,229 | A * | 1/1999 | Magnani, Jr. | 5/99.1 |
| 6,170,099 | B1 * | 1/2001 | Cheng | 5/99.1 |
| 6,256,814 | B1 * | 7/2001 | Drobinski | 5/99.1 |
| 6,336,234 | B1 | 1/2002 | Kuo | |
| 6,364,563 | B1 * | 4/2002 | Cheng | 403/102 |
| 6,665,895 | B1 | 12/2003 | St. Pierre et al. | |
| 6,725,475 | B1 * | 4/2004 | Chen | 5/98.1 |
| 7,552,487 | B2 * | 6/2009 | Chen | 5/99.1 |
| 7,591,031 | B2 * | 9/2009 | Yang | 5/99.1 |
| 7,676,860 | B2 * | 3/2010 | Cheng | 5/99.1 |
| 7,694,361 | B1 * | 4/2010 | Chen | 5/99.1 |
| 2003/0061657 | A1 | 4/2003 | Longenecker et al. | |
| 2007/0163041 | A1 * | 7/2007 | Cheng et al. | 5/99.1 |
| 2009/0193581 | A1 * | 8/2009 | Cheng | 5/99.1 |
| 2009/0320205 | A1 * | 12/2009 | Chen | 5/99.1 |

FOREIGN PATENT DOCUMENTS

| | | | |
|---|---|---|---|
| CN | 2684661 | Y | 3/2005 |
| EP | 1 430 816 | A1 | 6/2004 |

* cited by examiner

*Primary Examiner* — Victor MacArthur
*Assistant Examiner* — Jonathan Masinick
(74) *Attorney, Agent, or Firm* — Winston Hsu; Scott Margo

(57) ABSTRACT

A linking device is configured at the bottom of a playpen. Two of the bottom pipes at opposite side pivot to a base seat and further pivot to the linking device, which is engaged by a locking device so that the bottom pipes and the linking device are secured at an unfolding position. To fold the hub assembly, using a strap or by pushing the locking device directly pivots the locking device to disengage from the linking device and the bottom pipes may rotate to a folding position. To restore the hub assembly to the unfolding position, the linking device can be pressed to push an inclined surface of the locking device to impart a force to the locking device to pivot the locking device until the linking device snaps to engage the locking device, so the hub assembly is secured at the unfolding position again.

19 Claims, 11 Drawing Sheets

PLAYPEN HUB ASSEMBLY AND PLAYPEN USING THE SAME

BACKGROUND OF THE INVENTION

1. Field of the Invention

The present invention relates to hub assembly, and more specifically, to a hub assembly used for a playpen.

2. Description of the Prior Art

Generally, a hub assembly used in a playpen usually includes a base seat and a plurality of bottom pipes pivoting to the base seat radially. Users can fold the playpen by use of the hub assembly. An additionally locking device may be applied on the base seat to prevent unintentional folding. In other words, the locking device inhibits the bottom pipes from pivoting relative to the base seat when the hub assembly is set at an unfolding position. When it comes to folding the playpen, the locking device needs to be unlocked so that the bottom pipes can be released to pivot relative to the base seat, and the playpen can be folded thereafter.

The locking device aforementioned inhibits the bottom pipes from pivoting relative to the base seat by directly putting engagement on the bottom pipes. Complicated mechanism is always a must for the prior art locking devices.

Furthermore, other than those hub assembly using one-move operation to fold the playpen, some folding structures for the playpen use two-move releasing mechanism for safety concern, which means users must go through two operations to fold the playpen. Such one-move operative hub assemblies have safety issue to solve.

SUMMARY OF THE INVENTION

The invention provides a hub assembly that is easy for operation and has two-move locking safety protection.

The invention provides a playpen hub assembly. The playpen hub assembly includes a base seat, a first bottom pipe pivoting to one side of the base seat, a second bottom pipe pivoting to the opposite side of the base seat, a linking device, and a locking device. The first bottom pipe and the second bottom pipe are configurable to an unfolding position or a folding position relative to the base seat. The linking device pivots to the first bottom pipe and the second bottom pipe with its two ends and is moveable with the first bottom pipe and the second bottom pipe. The linking device is also configurable to a first position and a second position relative to the base seat when the first bottom pipe and the second bottom pipe are configured to the unfolding position and the folding position respectively. The locking device is configured at the base seat for engaging with the linking device and securing the linking device at the first position so that the first bottom pipe and the second bottom pipe are secured at the unfolding position.

The invention also provides a playpen. The playpen includes a frame and a playpen hub assembly. The frame includes an arm frame having a plurality of top corners, and a plurality of standing posts, each pivoting to the arm frame via one of the top corners. The playpen hub assembly includes a base seat, a first bottom pipe, a second bottom pipe, a third bottom pipe, a fourth bottom pipe, a linking device, and a locking device. Each of the bottom pipes pivots to the base seat with one end and pivots to the bottom of corresponding standing post with the other end respectively. The bottom pipes are configurable to an unfolding position or a folding position relative to the base seat. The linking device pivots to the first bottom pipe and the second bottom pipe with its two ends and is moveable with the first bottom pipe and the second bottom pipe. The linking device is also configurable to a first position and a second position relative to the base seat when the first bottom pipe and the second bottom pipe are configured to the unfolding position and the folding position respectively. The locking device is configured at the base seat for engaging with the linking device and securing the linking device at the first position so that the first bottom pipe and the second bottom pipe are secured at the unfolding position.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
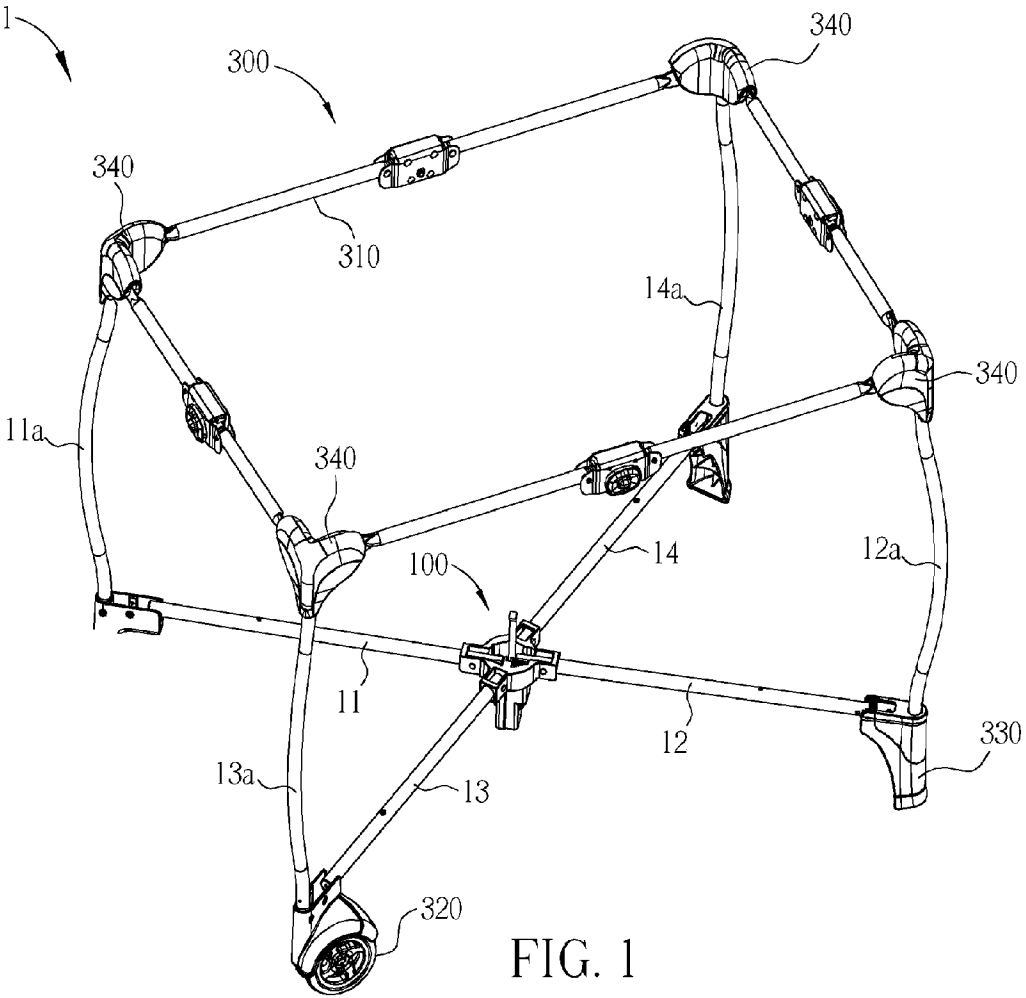
FIG. 1 shows a first embodiment of a playpen according to the invention.
Figure 2:
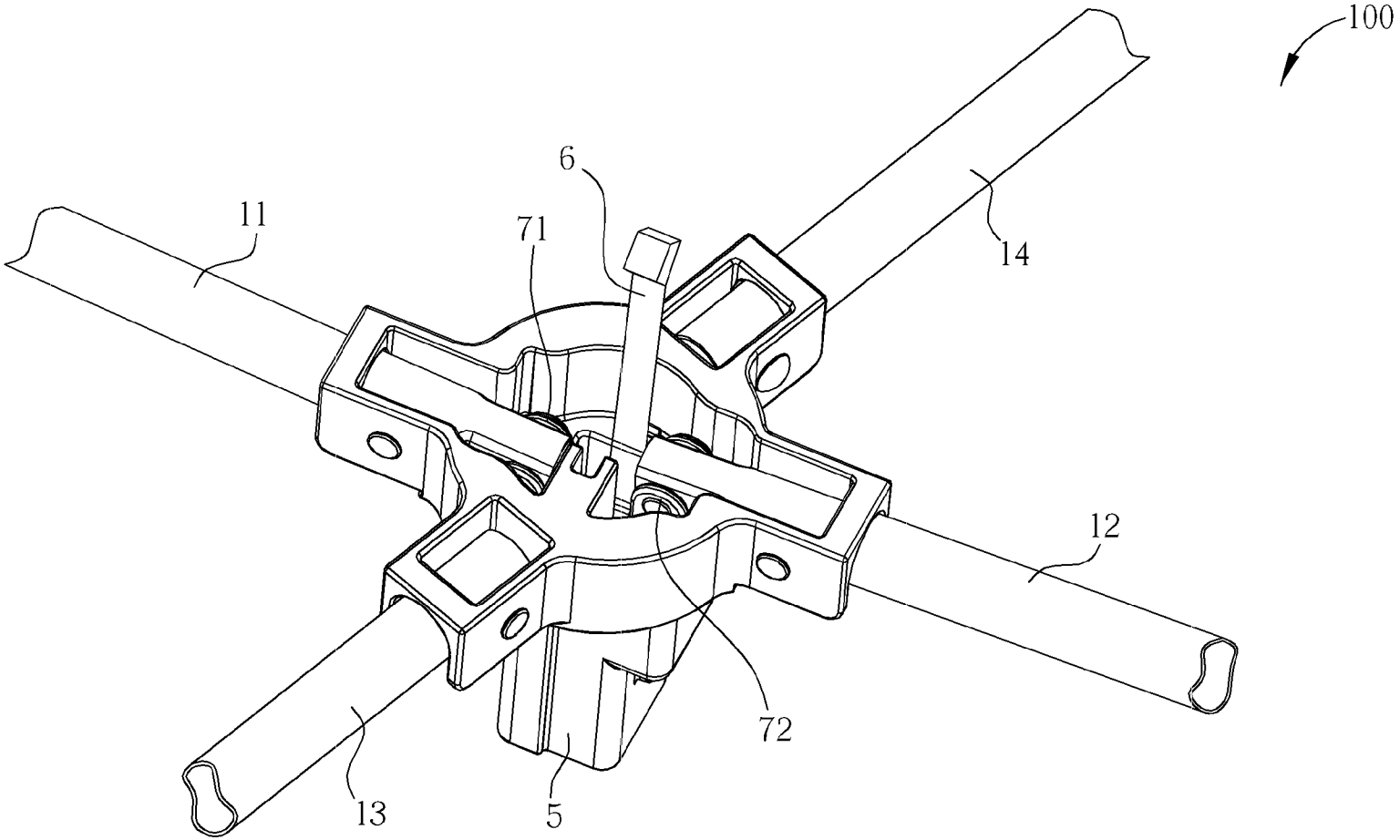
FIG. 2 shows a first embodiment of a playpen hub assembly.
Figure 3:
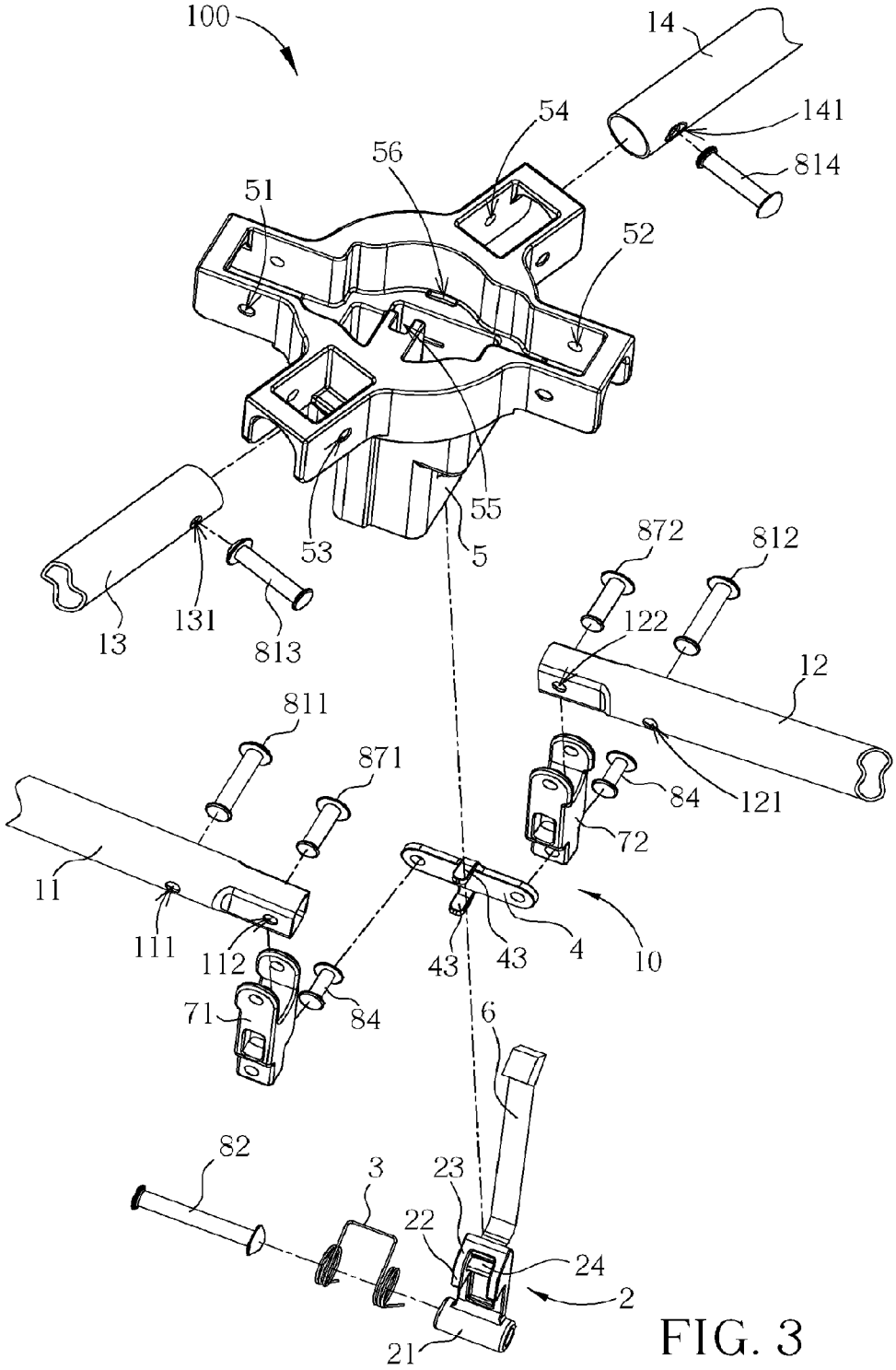
FIG. 3 is an exploded view of the hub assembly.
Figure 6:
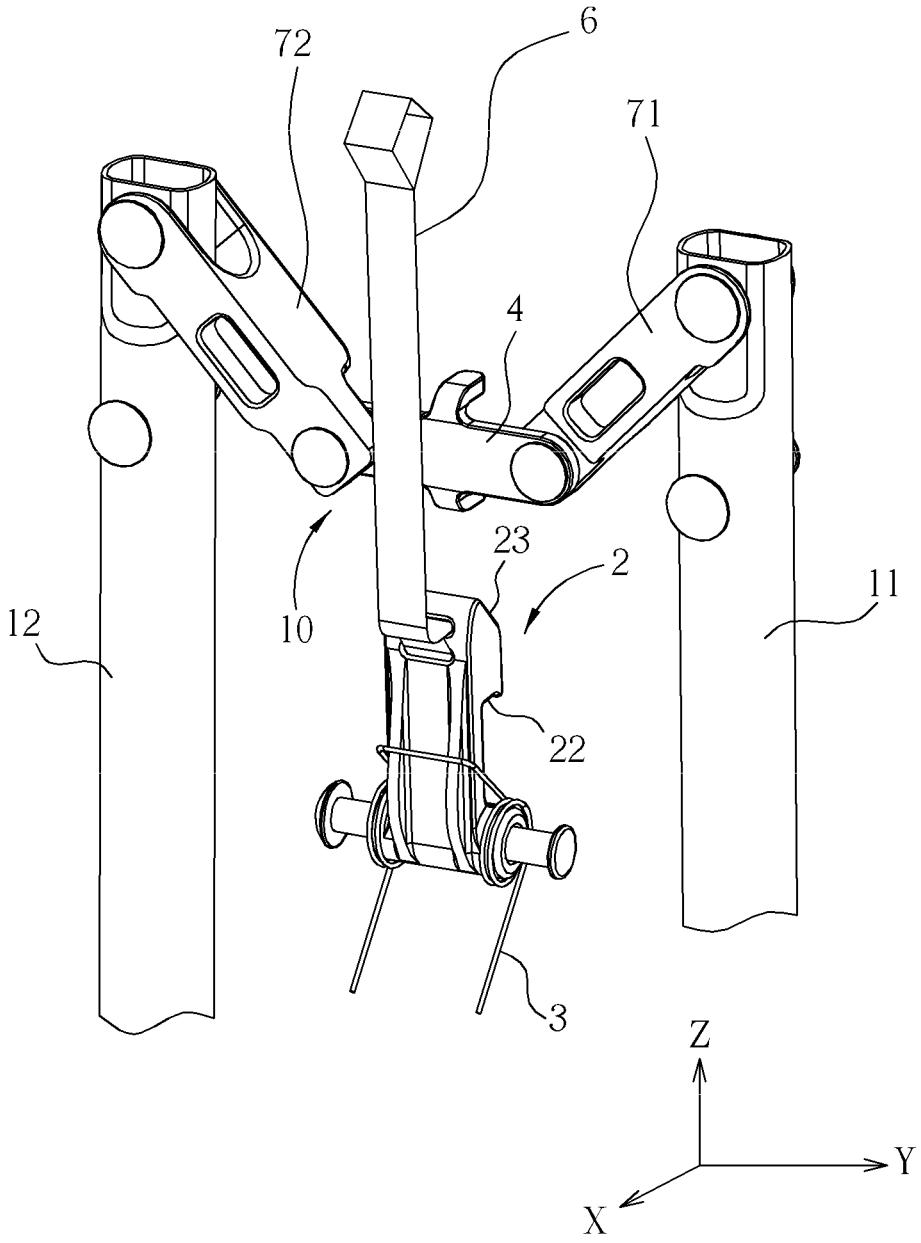
FIG. 6 is a schematic diagram showing the hub assembly at a folding position.

Please refer to FIG. 1, FIG. 2, and FIG. 3. FIG. 1 shows a first embodiment of a playpen 1 according to the invention, FIG. 2 shows a first embodiment of a playpen hub assembly 100, and FIG. 3 is an exploded view of the hub assembly 100. The hub assembly 100 may be applied on a foldable playpen 1. The frame 300 of the playpen 1 includes an arm frame 310, a plurality of top corners 340, and a plurality of standing posts 11*a*, 12*a*, 13*a*, 14*a*. Each of the standing posts 11*a*, 12*a*, 13*a*, 14*a* may pivot to the arm frame 310 with its top end via one of the top corners 340 and connect to a wheel 320 or a foot seat 330 with its the other end. Please refer to FIG. 2 and FIG. 3. The hub assembly 100 includes a base seat 5, a plurality of bottom pipes 11, 12, 13, 14, a linking device 10 (including an engaging component 4 and two pivoting components 71, 72), a locking device 2, and a strap 6. One end of each of the bottom pipes 11, 12, 13, 14 connects to each of the standing posts 11*a*, 12*a*, 13*a*, 14*a* respectively and the other end of each of the bottom pipes 11, 12, 13, 14 pivots to the base seat 5. The hub assembly 100 can therefore changes its state from an unfolding position as shown in FIG. 2 to a folding position as shown in FIG. 6 (FIG. 6 shows parts of the hub assembly 100) or from the folding position to the unfolding position, thereby allowing the playpen 1 to fold up or extend via the hub assembly 100. The bottom pipes 11, 12, 13, 14 pivot to the base seat 5 respectively in a way by passing rivets 811, 812, 813, 814 through pivoting holes 111, 121, 131, 141 and through pivoting slots 51, 52, 53, 54 of the base seat 5 respectively.

In addition to pivoting to the opposite sides of the base seat 5, the bottom pipes 11,12 also connect to each other via pivoting the linking device 10. Please refer to FIG. 4, which is a schematic diagram of partial hub assembly 100 as the bottom pipes 11, 12 are configured at the unfolding position. By passing rivets 871, 872 through pivoting holes 112, 122 respectively, the bottom pipes 11, 12 respectively pivot to the pivoting components 71, 72, which further pivot to the engaging component 4 via rivets 84 so as to form a linkage. When the bottom pipes 11, 12 moves from the unfolding position to the folding position or from the folding position to the unfolding position, the pivoting components 71, 72 and the engaging component 4 of the linking device 10 also move with the bottom pipes 11, 12 between the unfolding position and the folding position.

Preferably, the engaging component 4 includes a first guide and the base seat 5 includes a second guide that corresponds to the first guide. As the linking device 10 moves with the bottom pipes 11, 12 between the unfolding position and the folding position, the first guide interacts with the second guide so that the moving direction of the engaging component 4 can be restricted. FIG. 3 shows that in this embodiment, two protrusions 43 on the engaging component 4 are taken as the first guide and a groove 55 located on the inner wall of the base seat 5 and facing the engaging component 4 is taken as the second guide. When the engaging component 4 moves correspondingly with the bottom pipes 11, 12 between the unfolding position and the folding position, the protrusions 43 are confined to slide inside the groove 55, allowing for the engaging component 4 of the linking device 10 moving only along the groove 55, adding stability to the hub assembly 100 when folding or unfolding. However, the first guide of the engaging component 4 may be a groove and the second guide of the base seat 5 may be a track for confining the movement of the recess.

Figure 10:
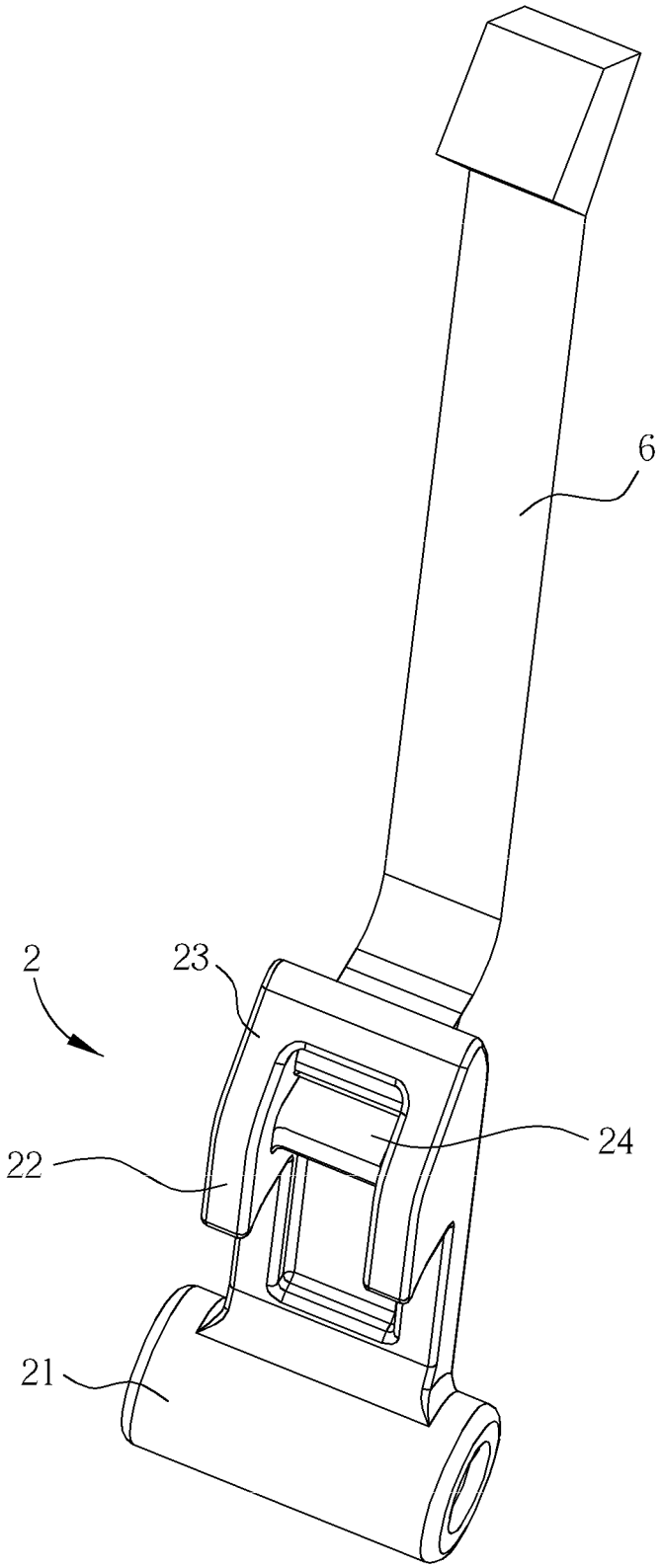
FIG. 10 is a schematic diagram of the locking device in connection with a strap in the first embodiment.

Please also refer to FIG. 10, which is a schematic diagram of the locking device 2. The locking device 2 of the embodiment according to the invention may be an engaging/actuating component pivoting to the base seat 5 by using a rivet 82 passing through a shaft 21. The locking device 2 includes a hook 22, an inclined surface 23 located on the hook 22, and an actuating segment 24. When the locking device 2 pivots to the base seat 5, the hook 22 may engage with the engaging component 4 of the linking device 10 such that the linking device 10 and the bottom pipes 11, 12 can be confined at the unfolding position. The hook 22 can be disengaged from the engaging component 4 when the locking device 2 rotates relative on the rivet 82 and the linking device 10 along with the bottom pipes 11, 12 are released, capable of moving to the folding position. Additionally, the strap 6 connects with its one end to the actuating segment 24 of the locking device 2 and the other end of the strap 6 passes through a slot 56 of the base seat 5 and extends upwardly. As the slot 56 opens on the edge side and top side of the inner wall of the base seat 5, pulling the other end of the strap 6 upwardly relative to the base seat 5 moves the locking device 6 to pivot relative to the base seat 5 accordingly. In FIG.3, the hub assembly 100 further includes an elastic component 3, which may be a torsion spring in this embodiment. The rivet 82 also passes through the elastic component 3 so that the elastic component 3 may be disposed between the base seat 5 and the locking device 2. When the locking device 2 is pulled by the strap 6 to rotate relative to the base seat 5, the elastic component 3 provides the locking device 2 with a reverse restoring stress and brings the locking device 2 back to an original position to have engagement with the linking device 10 after the strap 6 no longer pulls the locking device 2. Therefore, the linking device 10 may be engaged with the locking device 2 at the unfolding position and disengaged from the locking device 2, positioning above the locking device 2 at the folding position.

Figure 4:
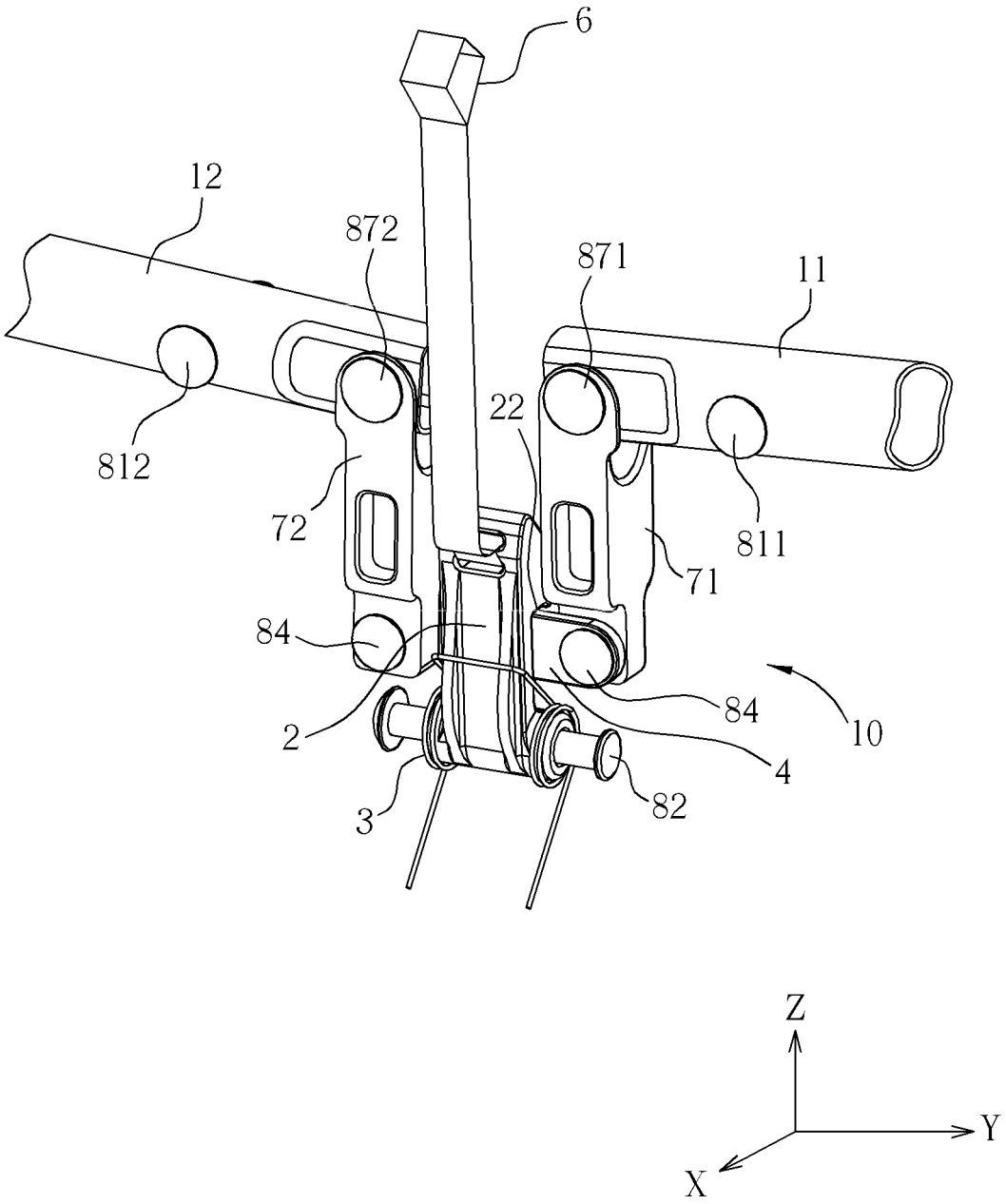
FIG. 4 is a schematic diagram of the hub assembly at the unfolding and locking position.
Figure 5:
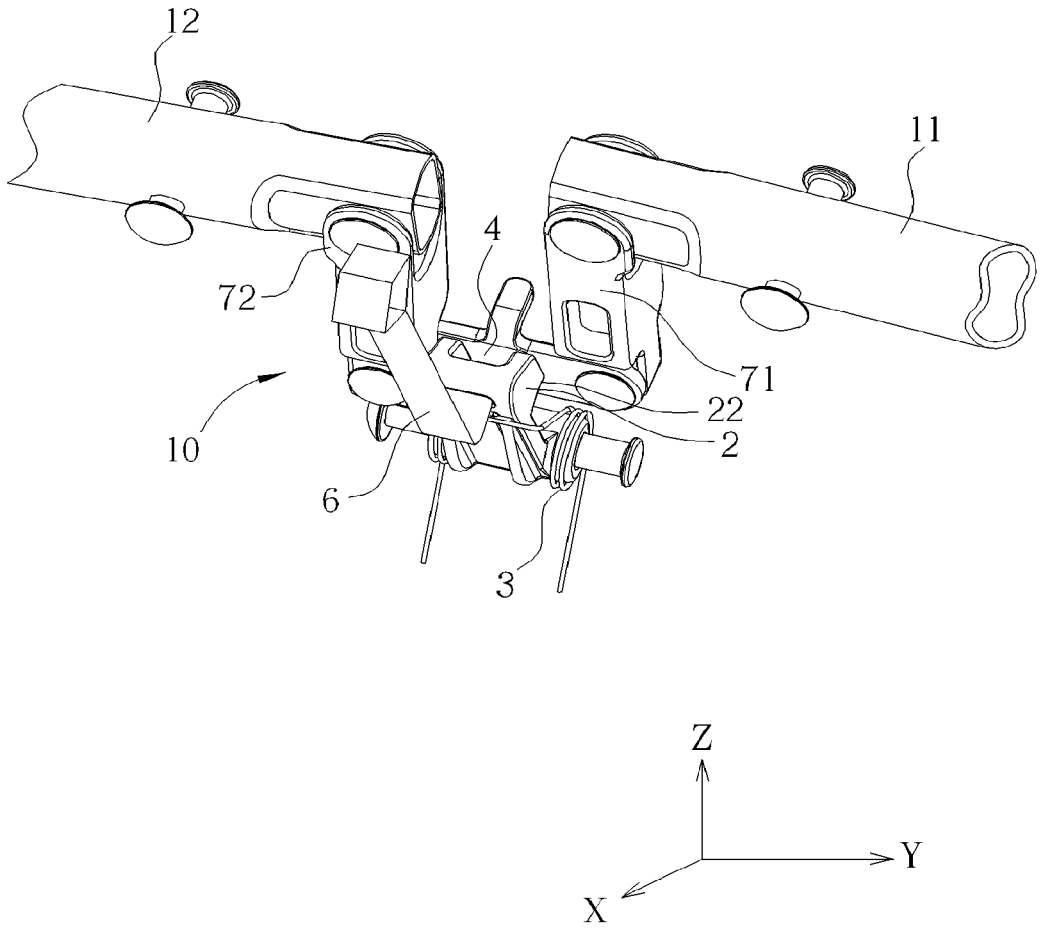
FIG. 5 is a schematic diagram showing the hub assembly at an unfolding position.

Please refer to FIG. 4 to FIG. 7, which illustrate successive movements of the partial hub assembly 100 from the unfolding position to the folding position to the unfolding position. FIG. 4 illustrates that when the hub assembly 100 is set at the unfolding position, the bottom pipes 11, 12 extend to direction Y and to the reverse direction of direction Y respectively. The hook 22 of the locking device 2 has engagement with the engaging component 4 of the linking device 10 so as to secure the linking device 10 at a first position, located at a lower inner place of the base seat 55. The bottom pipes 11, 12 are secured at the unfolding position. FIG. 5 illustrates that pulling the strap 6 releases the linking device 10. When pulling the strap 6 along direction Z, the other end of the strap 6 moves the actuating segment 24 of the locking device 2 toward direction X and the locking device 2 then pivots about Y-axis until the hook 22 disengages from the engaging component 4. In FIG. 6, the released bottom pipes 11, 12 then rotate to the folding position (the other bottom pipes 13, 14 can also rotate to the folding position) while the linking device 10 moves to a higher second position in the base seat 55. The locking device 2 may further restore to the position in FIG. 4 by rotating toward reverse of the direction X about Y-axis due to the restoring stress from the elastic component 3.

Figure 7:
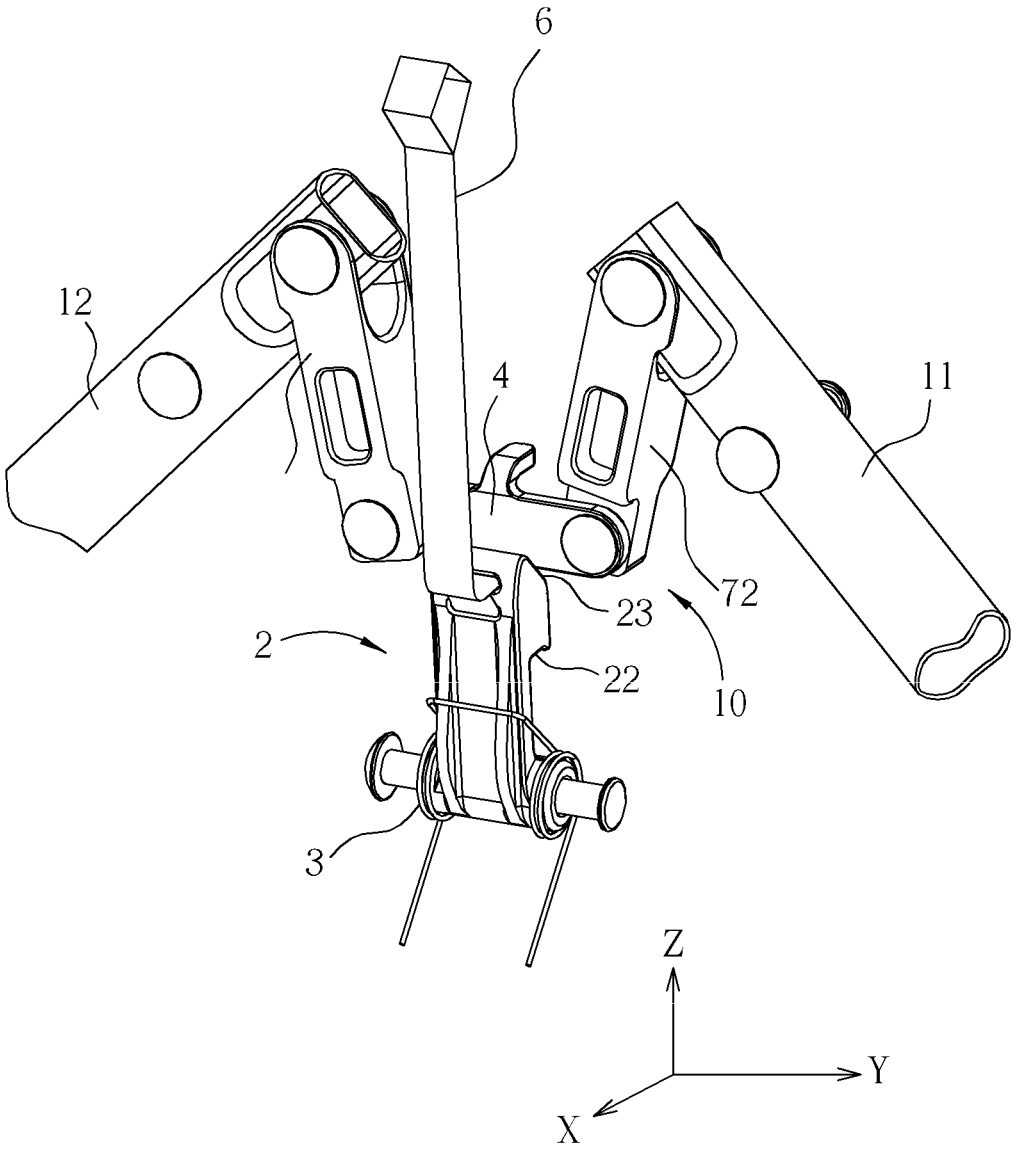
FIG. 7 is a schematic diagram showing the hub assembly restoring to the unfolding position.

To unfold the playpen 1, and to move the hub assembly 100 from the folding position to the unfolding position, the engaging component 4 is pressed down or the bottom pipes 11, 12 are raised upwardly as shown in FIG. 7 until the engaging component 4 abuts the inclined surface 23 of the locking device 2. Further pressing down the engaging component 4 will rotate the locking device 2 about Y-axis and the engaging component 4 moves to locate under the hook 22. The restoring stress of the elastic component 3 moves the locking device 2 to rotate about Y-axis toward reverse of the direction X to the unfolding position as shown in FIG. 4. The hook 22 of the locking device 2 engages with the engaging component 4 again to lock the hub assembly 100 at the unfolding position.

Additionally, even though the locking device 2 connects to the base seat 5 pivotally in the first embodiment, incorporating with the elastic component 3, the locking device 2 may also be fixed to the base seat 5 in other embodiments of the invention and with the elasticity of the locking device 2, it may be deformed when pulled and disengaged from, or engaged to the engaging component 4.

Figure 8:
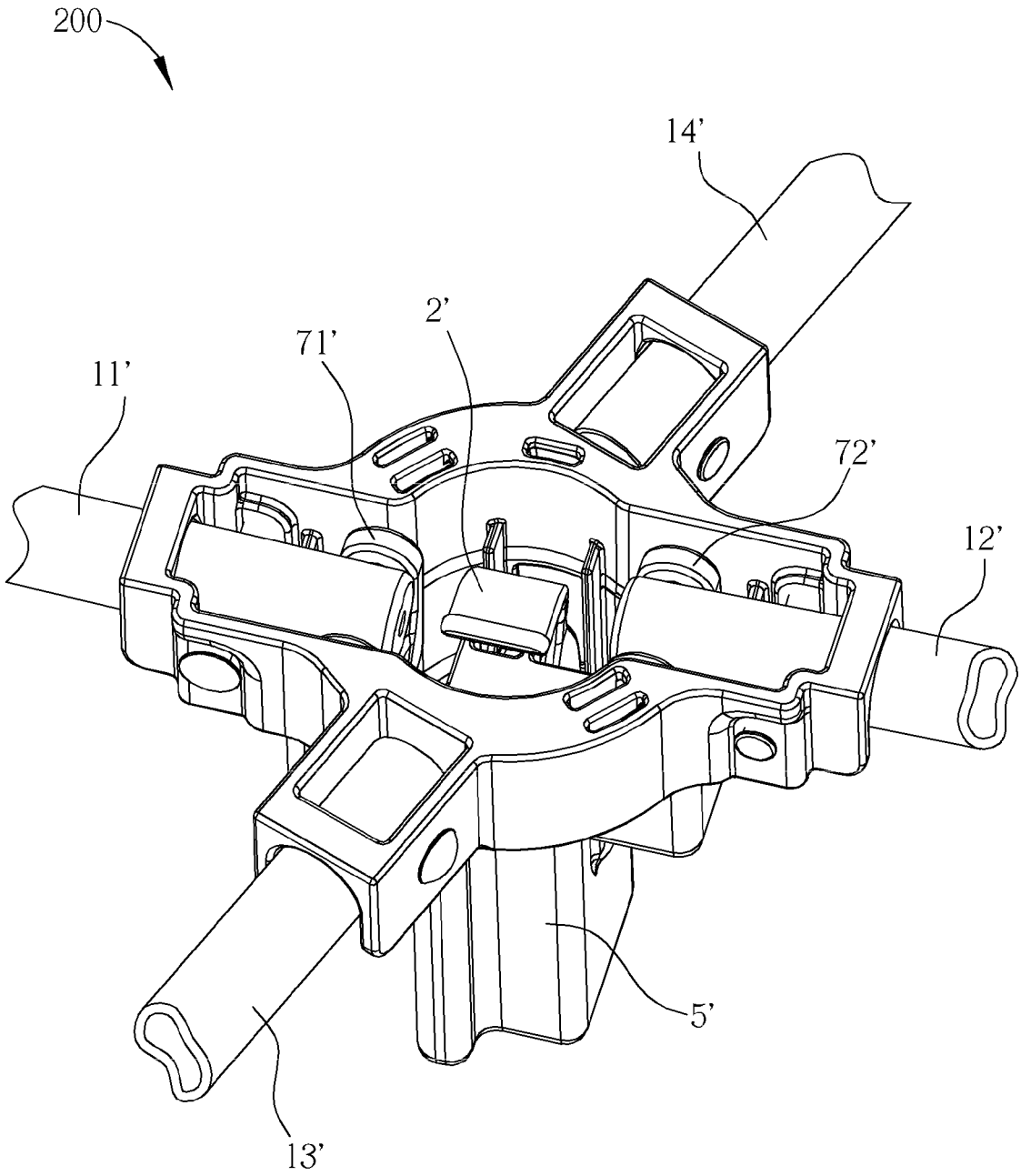
FIG. 8 shows a second embodiment of the playpen hub assembly.
Figure 9:
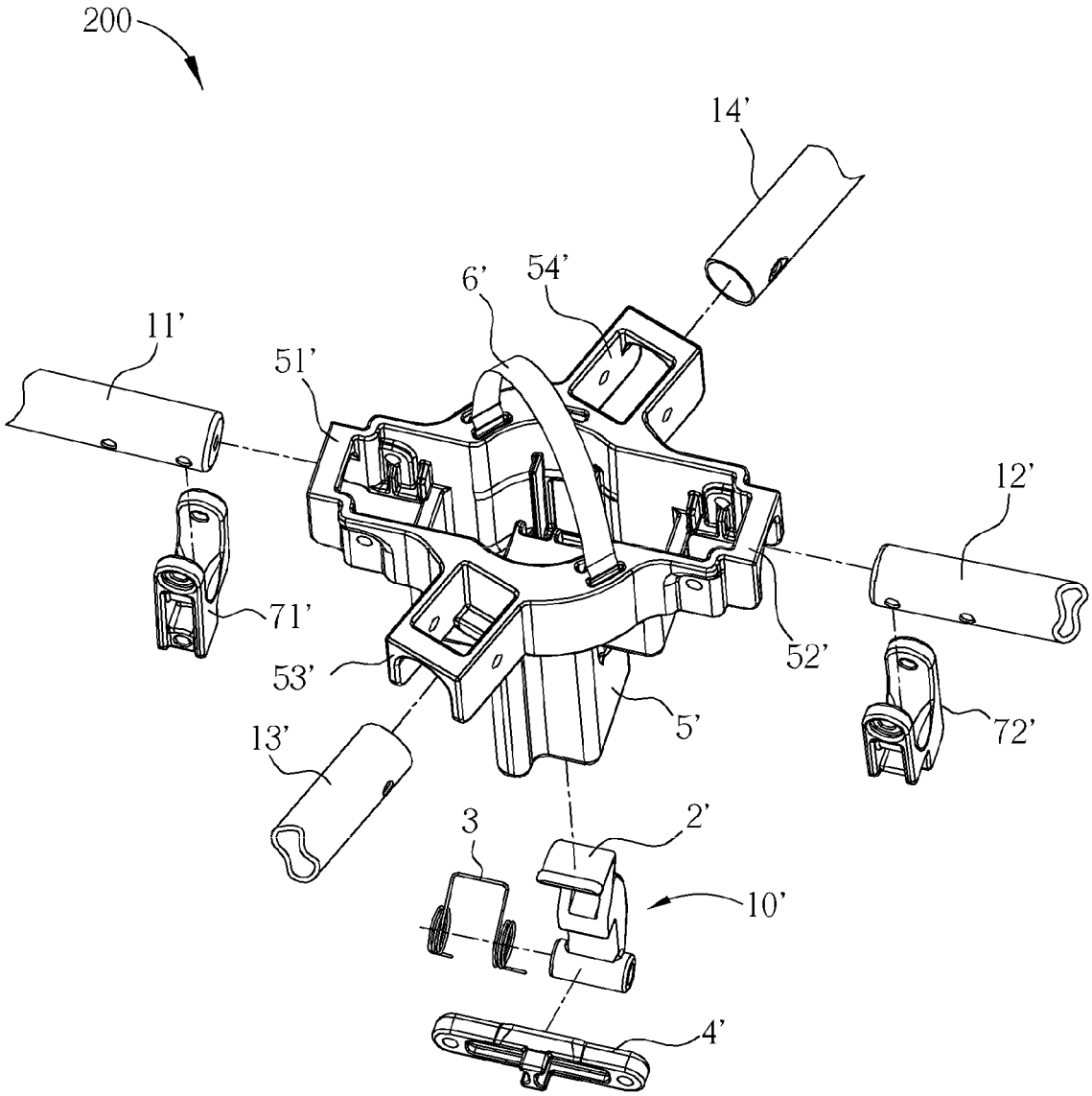
FIG. 9 is an exploded view of the hub assembly according to the second embodiment.

In the aforementioned first embodiment, by pulling the strap 6 can release and fold the hub assembly 100 in one movement. Hub assembly requiring two-move operation for safety concern is also disclosed in the following embodiment. As FIG. 8 and FIG. 9, a second embodiment of hub assembly 200 includes a base seat 5' a plurality of bottom pipes 11', 12', 13', 14', a linking device 10' (including an engaging component 4' and two pivoting components 71', 72'), a locking device 2', and a strap 6'. One end of each of the bottom pipes 11', 12', 13', 14' connects to each of the standing posts 11*a*, 12*a*, 13*a*, 14*a* respectively as shown in FIG. 1 and the other end of each of the bottom pipes 11', 12', 13', 14' pivots to the base seat 5'. The playpen 1 thereby can fold up or extend via the hub assembly 200. The bottom pipes 11', 12', 13', 14' pivot to the base seat 5' respectively in away by pivoting at the pivoting slots 51', 52', 53', 54' of the base seat 5' respectively.

Figure 11:
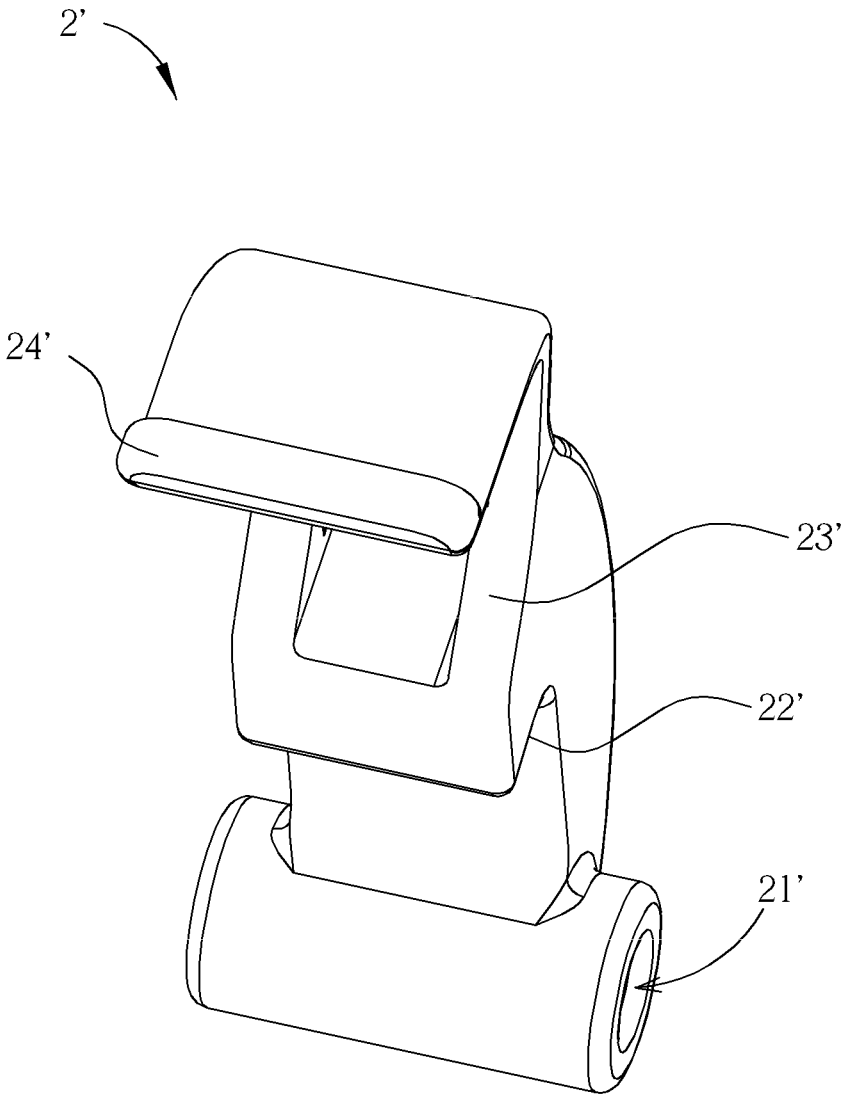
FIG. 11 is a schematic diagram of the locking device in the second embodiment.

The locking device 2' (shown in FIG. 11) includes a shaft 21', a hook 22', an inclined surface 23', and an actuating segment 24' (a handle for example). The actuating segment 24' extends from the hook 22' and over the inclined surface 23'. The actuating segment 24' may be used to disengage the locking device 2' from the linking device 10', thereby rotating the locking device 2' relative to the base seat 5'. The locking device 2' may also be fixed to the base seat 5' and with the elasticity of the locking device 2', it may be deformed when pulled and disengaged from or engaged to the engaging component 4'. The hub assembly 200 further includes a strap 6' connecting to the base seat 5' with its two ends. When the actuating segment 24' is pulled and disengaged from the engaging component 4', the strap 6' may be pulled to lift the base seat 5' and the linking device 10' and the bottom pipes 11', 12' may be moved from an unfolding position to a folding position while the bottom pipes 11', 12' rotate correspondingly. The components in this embodiment have similar operational structure as the first embodiment and the detailed operational description is omitted herein for brevity purpose. According to the second embodiment, to fold the playpen 1 from the unfolding position, the actuating segment 24' needs to be operated to release the linking device 10' and then the strap 6' needs to be pulled such that the playpen 1 is allowed to fold up completely.

The linking device is configured at the base seat at the bottom of the playpen for folding the playpen or unfolding the playpen. The bottom pipes of the hub assembly connect to the frame of the playpen with one end and pivot to the base seat with the other end. Two of the bottom pipes at opposite sides of the base seat further pivot to the linking device, which may be engaged by the locking device so that the bottom pipes and the linking device can be secured at an unfolding position. To fold the hub assembly, using the strap or pushing the locking device directly can pivot the locking device to disengage from the linking device and the bottom pipes are free to rotate to the folding position. To restore the hub assembly back to the unfolding position, the linking device can be pressed downward to push the inclined surface of the locking device to impart a component of force to the locking device to pivot the locking device until the linking device snaps to engage the locking device, so the hub assembly is secured at the unfolding position again.

Those skilled in the art will readily observe that numerous modifications and alterations of the device and method may be made while retaining the teachings of the invention.

What is claimed is:

1. A playpen, comprising:

a frame comprising:

an arm frame comprising a plurality of top corners; and a plurality of standing posts, each connecting to the arm frame via one of the top corners; and a playpen hub assembly, comprising:

a base seat;

a first bottom pipe, a second bottom pipe, a third bottom pipe, and a fourth bottom pipe, each pivoting to the base seat with one end and pivoting to the bottom of corresponding standing post with the other end respectively wherein the bottom pipes are configurable to an unfolding position or a folding position relative to the base seat;

a linking device pivoting to the first bottom pipe and the second bottom pipe with the linking device's two ends and moveable with the first bottom pipe and the second bottom pipe, the linking device configurable to a first position and a second position relative to the base seat when the first bottom pipe and the second bottom pipe are configured to the unfolding position and the folding position respectively, the linking device comprising:

an engaging component, wherein the base seat comprises a groove and the engaging component comprises a protrusion for sliding vertically in and along the groove, thereby restricting movement of the engaging component in a direction when the linking device moves between the first position and the second position along with the first bottom pipe and the second bottom pipe; and a first pivoting component pivotally connected to the first bottom pipe at a first end of the first pivoting component for pivoting with respect to the first bottom pipe, and pivotally connected to the engaging component at a second end of the first pivoting component for pivoting with respect to the engaging component; and a second pivoting component pivotally connected to the second bottom pipe at a first end of the second pivoting component for pivoting with respect to the second bottom pipe, and pivotally connected to the engaging component at a second end of the second pivoting component for pivoting with respect to the engaging component;

a locking device configured at the base seat abutting against the engaging component of the linking device to secure the linking device at the first position for securing the first bottom pipe and the second bottom pipe at the unfolding position, wherein a plane including the first bottom pipe, the second bottom pipe, the first pivoting component, and the second pivoting component is parallel to a pivot axis about which the locking device rotates when the locking device engages with and disengages from the engaging component; and an elastic component disposed between the base seat and the locking device and biasing the locking device against the engaging component.

2. The playpen of claim 1, wherein a first end of the locking device is secured at the base seat.

3. The playpen of claim 1, wherein a first end of the locking device pivots to the base seat.

4. The playpen of claim 3, wherein the elastic component provides a restoring stress for the locking device when the locking device pivots to a release direction relative to the base seat.

5. The playpen of claim 3, wherein the locking device comprises:

a pivoting segment located at the first end of the locking device for pivoting to the base seat;

a hook located at a second end of the locking device for engaging with the linking device;

an inclined surface extending on the hook for being pushed by the linking device for moving the locking device to pivot relative to the base seat when the first bottom pipe and the second bottom pipe move from the folding position to the unfolding position; and an actuating segment for moving the locking device to pivot to a release direction relative to the base seat, thereby disengaging the hook from the linking device.

6. The playpen of claim 5, wherein the actuating segment extends on the inclined surface for being pulled to disengage the locking device from the linking device.

7. The playpen of claim 6, wherein the playpen hub assembly further comprises a strap connecting to the base seat with its two ends, wherein after the locking device disengages from the linking device, the strap is pulled to move the base seat relative to the first bottom pipe and the second bottom pipe, thereby moving the first bottom pipe and the second bottom pipe to the folding position.

8. The playpen of claim 5, wherein the playpen hub assembly further comprises a strap connecting to the actuating segment for moving the locking device to pivot relative to the base seat.

9. The playpen of claim 8, wherein the base seat further comprises an opening channel through which the strap passes to connect to the actuating segment.

10. A playpen hub assembly, comprising:

a base seat;

a first bottom pipe pivoting to one side of the base seat;

a second bottom pipe pivoting to the opposite side of the base seat, wherein the first bottom pipe and the second bottom pipe are configurable to an unfolding position or a folding position relative to the base seat;

a linking device pivoting to the first bottom pipe and the second bottom pipe with the linking device's two ends and moveable with the first bottom pipe and the second bottom pipe, the linking device configurable to a first position and a second position relative to the base seat when the first bottom pipe and the second bottom pipe are configured to the unfolding position and the folding position respectively, the linking device comprising:

an engaging component, wherein the base seat comprises a groove and the engaging component comprises a protrusion for sliding vertically in and along the groove, thereby restricting movement of the engaging component in a direction when the linking device moves between the first position and the second position along with the first bottom pipe and the second bottom pipe; and a first pivoting component pivotally connected to the first bottom pipe at a first end of the first pivoting component for pivoting with respect to the first bottom pipe, and pivotally connected to the engaging component at a second end of the first pivoting component for pivoting with respect to the engaging component; and a second pivoting component pivotally connected to the second bottom pipe at a first end of the second pivoting component for pivoting with respect to the second bottom pipe, and pivotally connected to the engaging component at a second end of the second pivoting component for pivoting with respect to the engaging component;

a locking device configured at the base seat abutting against the engaging component of the linking device to secure the linking device at the first position for securing the first bottom pipe and the second bottom pipe at the unfolding position, wherein a plane including the first bottom pipe, the second bottom pipe, the first pivoting component, and the second pivoting component is parallel to a pivot axis about which the locking device rotates when the locking device engages with and disengages from the engaging component; and an elastic component disposed between the base seat and the locking device and biasing the locking device against the engaging component.

11. The playpen hub assembly of claim 10, wherein a first end of the locking device is secured at the base seat.

12. The playpen hub assembly of claim 10, wherein a first end of the locking device pivots to the base seat.

13. The playpen hub assembly of claim 12, wherein the elastic component provides a restoring stress for the locking device when the locking device pivots to a release direction relative to the base seat.

14. The playpen hub assembly of claim 12, wherein the locking device comprises:

a pivoting segment located at the first end of the locking device for pivoting to the base seat;

a hook located at a second end of the locking device for engaging with the linking device;

an inclined surface extending on the hook for being pushed by the linking device for moving the locking device to pivot relative to the base seat when the first bottom pipe and the second bottom pipe move from the folding position to the unfolding position; and an actuating segment for moving the locking device to pivot to a release direction relative to the base seat, thereby disengaging the hook from the linking device.

15. The playpen hub assembly of claim 14, wherein the actuating segment extends on the inclined surface for being pulled to disengage the locking device from the linking device.

16. The playpen hub assembly of claim 15, further comprising a strap connecting to the base seat with its two ends, wherein after the locking device disengages from the linking device, the strap is pulled to move the base seat relative to the first bottom pipe and the second bottom pipe, thereby moving the first bottom pipe and the second bottom pipe to the folding position.

17. The playpen hub assembly of claim 14, further comprising a strap connecting to the actuating segment for moving the locking device to pivot relative to the base seat.

18. The playpen hub assembly of claim 17, wherein the base seat further comprises an opening channel through which the strap passes to connect to the actuating segment.

19. The playpen hub assembly of claim 10, further comprising a third bottom pipe and a fourth bottom pipe, each pivoting to the base seat.

* * * * *